US007797859B2

(12) United States Patent
LeBlond et al.

(10) Patent No.: US 7,797,859 B2
(45) Date of Patent: Sep. 21, 2010

(54) SNOWPLOW AND MOUNT ASSEMBLY

(75) Inventors: Andre Valmont LeBlond, Owlshead, ME (US); James Calvin Pieper, Glen Cove, ME (US); Mark Lawrence Stultz, Whitefield, ME (US); Steven Lohry Klug, Union, ME (US); John Wallace Field, Hope, ME (US); David Bloxdorf, Hubertus, WI (US)

(73) Assignee: Douglas Dynamics, L.L.C., Milwaukee, WI (US)

( * ) Notice: Subject to any disclaimer, the term of this patent is extended or adjusted under 35 U.S.C. 154(b) by 0 days.

(21) Appl. No.: 12/729,473

(22) Filed: Mar. 23, 2010

(65) Prior Publication Data

US 2010/0175281 A1 Jul. 15, 2010

Related U.S. Application Data

(60) Division of application No. 12/246,671, filed on Oct. 7, 2008, now Pat. No. 7,681,334, which is a division of application No. 11/231,072, filed on Sep. 20, 2005, now Pat. No. 7,430,821, which is a continuation of application No. 09/878,744, filed on Jun. 11, 2001, now Pat. No. 6,944,978.

(51) Int. Cl.
*E01H 5/00* (2006.01)

(52) U.S. Cl. ..... 37/231; 172/274

(58) Field of Classification Search ..... 37/231–236, 37/266, 270, 271, 277; 172/272–275, 817, 172/456; 280/416.2, 479.1; 414/723
See application file for complete search history.

(56) References Cited

U.S. PATENT DOCUMENTS 3,410,006 A 11/1968 Vogel
3,410,008 A 11/1968 Standfuss
3,987,562 A 10/1976 Deen et al.
4,096,652 A 6/1978 Raines et al.
4,924,610 A * 5/1990 Sodemann ..... 37/231
4,962,599 A * 10/1990 Harris ..... 37/266
5,014,452 A * 5/1991 Berghefer ..... 37/235
5,031,927 A * 7/1991 Frenette ..... 280/481
5,050,321 A * 9/1991 Evans ..... 37/232

(Continued)

*Primary Examiner*—Robert E Pezzuto
(74) *Attorney, Agent, or Firm*—Wood, Herron & Evans, LLP

(57) ABSTRACT

A snowplow and mount assembly comprising a mount frame adapted to be secured to a vehicle, and a snowplow frame. One of the mount frame and the snowplow frame has first and second arms and the other of the mount frame and snowplow frame has first and second receivers, the first and second receivers receiving the first and second arms, respectively. Respective ones of first and second latch pins removably secure the first and second arms in the first and second receivers. A latch lever is operably associated with the first and second latch pins and simultaneously actuates the latch pins to latched and unlatched positions. The snowplow frame includes a jack stand movable to and between an extended ground contacting and snowplow frame supporting position and a retracted ground noncontacting and snowplow frame nonsupporting position. The latch lever operably frees the jack stand for movement into the extended position when the latch pins are in the unlatched position and operably prevents jack stand movement maintaining the jack stand in the retracted position when the latch pins are in the latched position.

4 Claims, 6 Drawing Sheets

U.S. PATENT DOCUMENTS 5,111,603 A * 5/1992 Knowlton et al. ..... 37/231
5,195,261 A * 3/1993 Vachon ..... 37/231
5,353,530 A * 10/1994 Pieper ..... 37/231
5,485,690 A * 1/1996 MacQueen ..... 37/271
5,568,694 A 10/1996 Capra et al.
5,815,956 A 10/1998 Lavin et al.
6,012,240 A * 1/2000 Klug et al. ..... 37/231
6,035,944 A 3/2000 Neuner et al.
6,088,937 A 7/2000 DiClementi et al.
6,108,946 A 8/2000 Christy
6,134,814 A 10/2000 Christy et al.
6,145,222 A 11/2000 Curtis
6,209,231 B1 4/2001 Curtis
6,354,024 B1 3/2002 Kost et al.
6,408,546 B2 6/2002 Curtis
6,526,677 B1 3/2003 Bloxdorf et al.
6,874,582 B2 4/2005 Hollinrake et al.
6,944,978 B2 9/2005 LeBlond et al.
7,430,821 B2 10/2008 LeBlond et al.
7,681,334 B2 3/2010 LeBlond et al.

* cited by examiner

SNOWPLOW AND MOUNT ASSEMBLY

RELATED APPLICATIONS

This application is a divisional of U.S. application Ser. No. 12/246,671 filed Oct. 7, 2008, now U.S. Pat. No. 7,681,334 issued Mar. 23, 2010, which is a divisional of U.S. application Ser. No. 11/231,072 filed Sep. 20, 2005, now U.S. Pat. No. 7,430,821 issued Oct. 7, 2008, which is a continuation of U.S. application Ser. No. 09/878,744 filed Jun. 11, 2001, now U.S. Pat. No. 6,944,978 issued Sep. 20, 2005, all of which are hereby incorporated by reference.

FIELD OF THE INVENTION

This invention relates generally to snow removal equipment and, more particularly, to a snowplow and mount assembly for removably securing a snowplow to a vehicle.

BACKGROUND OF THE INVENTION

It is desirable to provide a snow plow assembly with a mechanism affording attachment to and detachment from a vehicle. The vehicle operator may wish to remove the snow blade during times when the need for plowing snow arises infrequently or when the vehicle is used for purposes other than plowing snow.

To that end the assignee of the present invention obtained U.S. Pat. No. 5,353,530, hereby incorporated by reference herein as if fully set forth in its entirety. That patent discloses a mount frame having arms and a snowplow frame having receivers which receive the arms. The snowplow frame includes a lift frame and an A-frame pivoted to the lift frame. The receivers are formed as a part of the lift frame. The receivers carry latch pins which are spring biased toward a latching position yet which are lockable in an unlatched position. When the arms of the mount frame have been driven into the receivers of the lift frame each of the latch pins are individually released; the bias of the springs drives the pins through holes in the receivers and in the arms thereby latching the lift frame and hence snowplow to the mount frame and hence vehicle. A jack stand is carried by the lift frame and is manually movable to and between an extended ground contacting and snowplow supporting position and a retracted ground noncontacting and snowplow nonsupporting position.

It is desirable to improve upon the invention of U.S. Pat. No. 5,353,530 by providing a snowplow and mount assembly which facilitates more efficient latching of the latch mechanism removably securing the snowplow to the mount and which facilitates more efficient deployment of the jack stand of the snowplow.

SUMMARY OF THE INVENTION

In one aspect the invention is a snowplow and mount assembly comprising a mount frame adapted to be secured to a vehicle, and a snowplow frame. One of the mount frame and the snowplow frame has first and second arms and the other of the mount frame and snowplow frame has first and second receivers, the first and second receivers receiving the first and second arms, respectfully. Respective ones of first and second latch pins removably secure the first and second arms in the first and second receivers. A latch lever is operably associated with the first and second latch pins and simultaneously actuates the latch pins to latched and unlatched positions.

The assembly can further comprise a spring biasing each latch pin into the latched position and a pin extractor associated with each latch pin and actuatable by the latch lever to extract the latch pin from the latch arm against the bias of the spring. The extractor can include a cam which operably cams against the latch pin during the extraction thereof. The latch pin and respective extractor can be mounted in brackets mounted to the snowplow frame, the brackets guiding movement of the latch pin and extractor. The latch pins can travel transversely relative to a longitudinal axis of the assembly and the extractors can travel perpendicularly relative to the travel of the pins. The latch pin can include a cross pin therethrough which can compress the spring against a wall of the bracket as the cam cams against the cross pin. The cam surface can be a ramp.

The latch lever can be pivotally connected to the snowplow frame, and the assembly can further include first and second linkages connected between the latch lever and the extractors. Each of the first and second linkages can include a linkage arm connected to the latch lever, and a linkage rod pivotally connected on a first end to the linkage arm and connected on a second end to the extractor. The latch lever can include a connecting rod extending transversely of the snowplow frame, with the first and second linkages being connected to the connecting rod.

The first and second arms can be part of the mount frame and the first and second receivers can be part of the snowplow frame. The snowplow frame can comprise a lift frame and an A-frame pivotally connected to the lift frame on a rearward end of the A-frame. The assembly can further comprise a plow blade mounted on a forward end of the A-frame.

In another aspect the invention is a snowplow and mount assembly comprising a mount frame adapted to be secured to a vehicle and a snowplow frame including a jack stand movable to and between an extended ground contacting and snowplow frame supporting position and a retracted ground noncontacting and snowplow frame nonsupporting position. A latch mechanism removably secures the snowplow frame to the mount frame. A latch lever actuates the latch mechanism to latched and unlatched positions, the latch lever operably freeing the jack stand for movement into the extended position when the latch mechanism is in the unlatched position and operably preventing jack stand movement maintaining the jack stand in the retracted position when the latch mechanism is in the latched position.

The assembly can further comprise first and second jack stand locks, the first lock preventing relative movement of the jack stand relative to the snowplow frame when the jack stand is in the extended position and the second lock preventing relative movement of the jack stand relative to the snow plow frame when the jack stand is in the retracted position. The first jack stand lock can comprise a jack stand lock lever having an aperture therein through which a leg of the jack stand passes and a spring biasing an edge of the lock lever aperture into contact with the jack stand leg. The spring and lock lever normally prevent upward movement of the jack stand relative to the snowplow frame while permitting downward movement of the jack stand relative to the snowplow frame, whereas pivoting the lock lever against the bias of the spring frees the jack stand leg from the lock lever aperture edge permitting upward movement of the jack stand relative to the snowplow frame.

The second jack stand lock can comprise a jack stand lock pin moveable into and out of an aperture in a leg of the jack stand and a spring biasing the lock pin toward the jack stand leg. The spring and lock pin normally prevent downward movement of the jack stand relative to the snowplow frame, whereas urging the lock pin against the bias of the spring frees the jack stand leg from the pin permitting downward movement of the jack stand relative to the snowplow frame. The jack stand can drop by gravity to the extended position when the jack stand leg is freed from the pin.

The latch lever can include a cam operably connected thereto and the jack stand lock pin can be fixed to a cam follower which cooperates with the cam such that pivoting the latch lever to actuate the latch mechanism to the unlatched position urges the cam follower and hence the jack stand lock pin against the bias of the spring and away from the jack leg and out of the aperture thereof, whereas pivoting the latch lever to actuate the latch mechanism to the latched position permits the spring to bias the jack stand lock pin toward the jack stand leg and into the aperture thereof.

The latch lever can include a connecting rod extending transversely of the snowplow frame, the cam can be a cylinder encircling the connecting rod affixed thereto and the cam follower can be a cylinder encircling the connecting rod and a slidable relative thereto. The cam cylinder and cam follower cylinder can have mating arcuate surfaces.

In further aspects the invention provides methods of attaching a snowplow frame to and detaching a snowplow frame from a mount frame. A method of attaching a snowplow frame to a mount frame comprises providing a mount frame secured to a vehicle and a snowplow frame, one of the mount frame and the snowplow frame having first and second arms and the other of the mount frame and the snowplow frame having first and second receivers, the first and second receivers receiving the first and second arms, respectively, one of the mount frame and the snowplow frame having first and second latch pins, respective ones of which removably secure the first and second arms in the first and second receivers, and a lever operably associated with the first and second latch pins to simultaneously actuate the latch pins to a latched position, effecting relative movement between the mount frame and the snowplow frame so that the receivers receive the arms therein and actuating the lever to simultaneously actuate the pins to the latched position.

A method of detaching a snowplow frame from a mount frame comprises providing a mount frame secured to a vehicle and a snowplow frame removably attached to the mount frame, one of the mount frame and the snowplow frame having first and second arms and the other of the mount frame and the snowplow frame having first and second receivers, the first and second receivers receiving the first and second arms, respectively, one of the mount frame and the snowplow frame having first and second latch pins, respective ones of which removably secure the first and second arms in the first and second receivers, and a lever operably associated with the first and second latch pins to simultaneously actuate the latch pins to an unlatched position, actuating the lever to simultaneously actuate the latch pins to the unlatched position and effecting relative movement between the mount frame and the snowplow frame so that the arms move out of the receivers.

Another method of detaching a snowplow frame from a mount frame comprises providing a mount frame secured to a vehicle and a snowplow frame removably attached to the mount frame, the snowplow frame including a jack stand moveable to and between an extended ground contacting and snowplow frame supporting position and a refracted ground noncontacting and snowplow frame nonsupporting position, one of the mount frame and the snowplow frame having a latch mechanism which removably secures the snowplow frame to the mount frame and a lever which actuates the latch mechanism to an unlatched position and which frees the jack stand for movement into the extended position, actuating the lever to actuate the latch mechanism to the unlatched position and to free the jack stand to drop by gravity to the extended position, and effecting relative movement between the mount frame and the snowplow frame to separate the mount frame from the snowplow frame.

The invention thus provides for the simultaneous latching and unlatching of the latch pins of a snowplow and for the automatic deployment of the snowplow jack stand during unlatching of the latch mechanism of the snowplow.

These and other features and advantages of the present invention will become more readily apparent during the following detailed description taken in conjunction with the drawings herein, in which:

BRIEF DESCRIPTION OF THE DRAWINGS OF THE INVENTION

DETAILED DESCRIPTION OF A PREFERRED EMBODIMENT OF THE INVENTION

Figure 1:
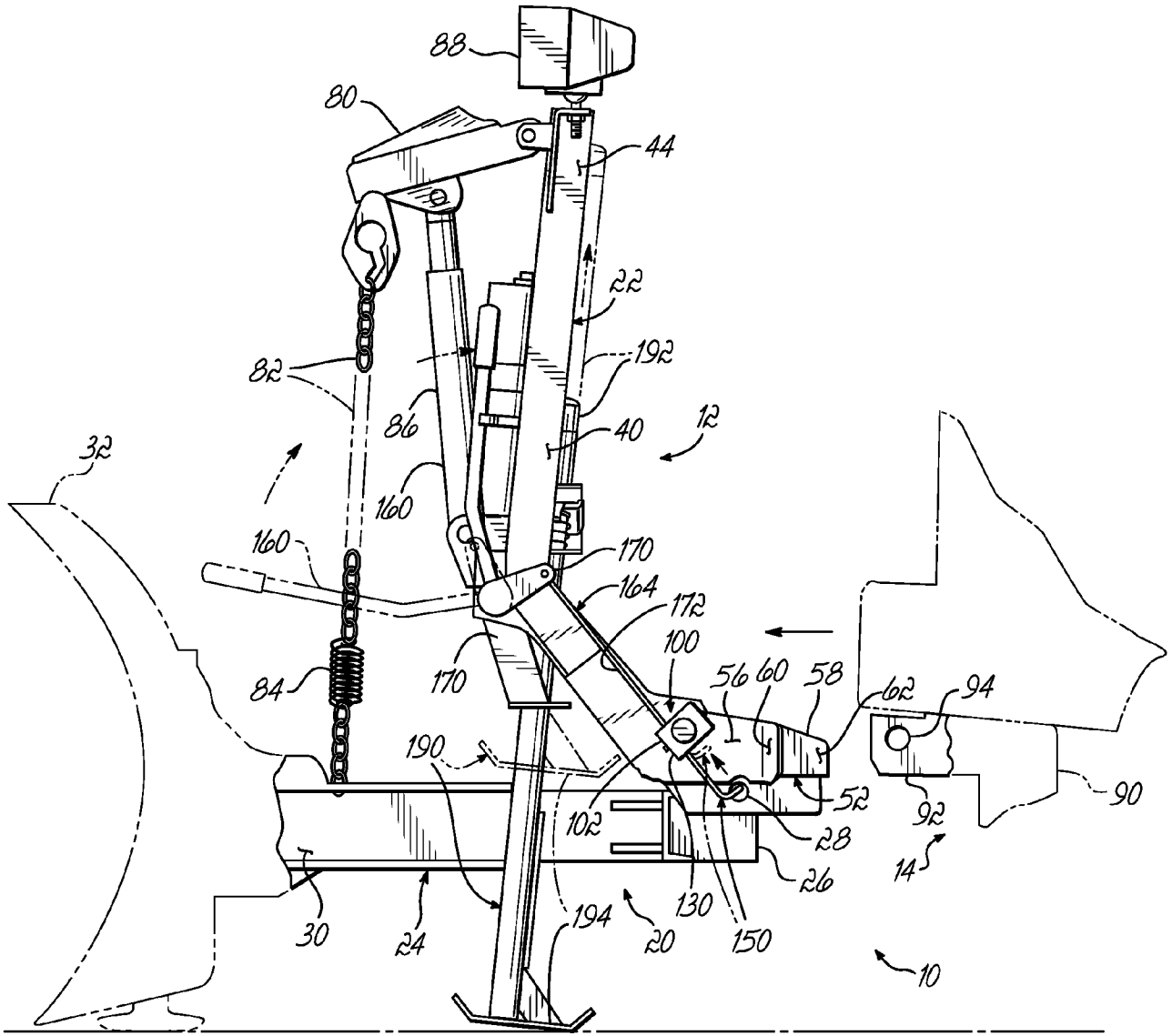
FIG. 1 is a side view of the snowplow and mount assembly of the present invention.
Figure 2:
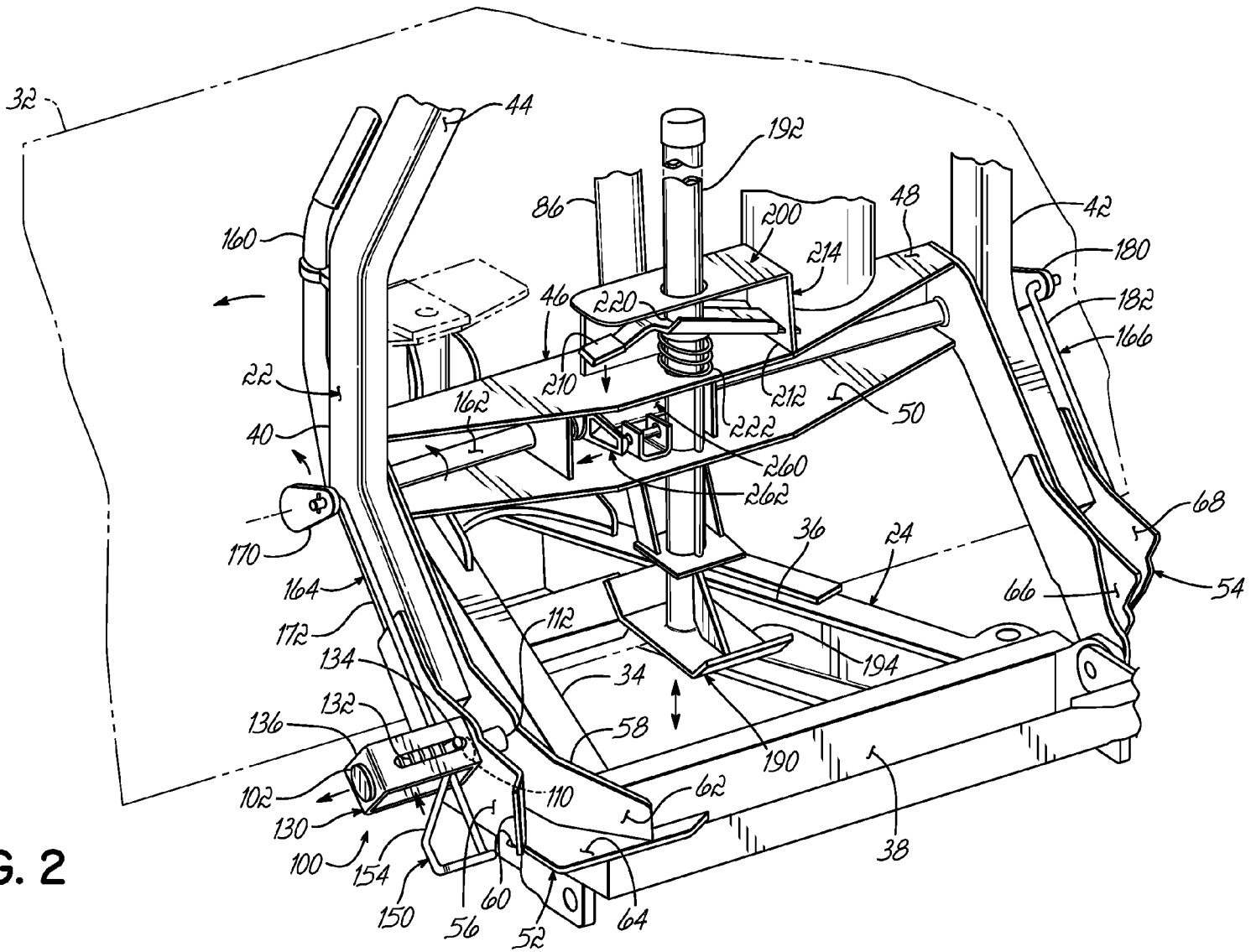
FIG. 2 is a rear perspective view of the snowplow assembly of FIG. 1.

Referring first to FIGS. 1 and 2 there is illustrated a snowplow and mount assembly 10 according to the principles of the present invention. Snowplow and mount assembly 10 comprises a snowplow assembly 12 and a mount assembly 14. Snowplow assembly 12 can comprise a snowplow frame 20 having a lift frame 22 and an A-frame 24 pivoted to the lift frame 22. A-frame 24 can be pivotally connected to lift frame 22 on a rearward end 26 of the A-frame 24 such as by bolt 28 for example. A forward end 30 of the A-frame 24 can carry a plow blade 32. A-frame 24 can comprise left and right hand A-frame elements 34, 36, respectively, and a transverse element 38 interconnecting left and right hand A-frame elements 34, 36.

Lift frame 22 can comprise left and right hand upwardly extending elements 40, 42, respectively, interconnected at their upper ends by transversely extending element 44. Another transversely extending element 46 can interconnect the elements 40, 42 generally medially of the height extent of the elements 40, 42. Transversely extending element 46 can include top 48 and bottom 50 plates.

The lower ends of elements 40, 42 of lift frame 22 can include receivers 52, 54, respectively. Left hand receiver 52 can include sidewalls 56, 58 having outwardly flared end portions 60, 62, respectively. A floor 64 can interconnect the sidewalls 56, 58. Similarly, right hand receiver 54 can include sidewalls 66, 68 having outwardly flared end portions 70, 72, respectively. A floor 74 can interconnect the sidewalls 66, 68.

Lift frame 22 can include a lift arm 80 pivoted to transversely extending element 44. A lift chain 82 and spring 84 can connect the lift arm 80 to the A frame 24. Alternatively a flexible wire rope cable can be used in place of the lift chain 82. A lift cylinder 86 can be pivotally mounted to the lift arm 80 and transversely extending element 46 of the lift frame 22, for raising and lowering lift arm 80 and hence A-frame 24 and plow blade 32. Head light 88 can be mounted to transversely extending element 44.

Referring now back to FIG. 1, mount assembly 14 can comprise a mount frame 90 adapted to be secured to a vehicle (phantom) having a pair of spaced arms 92, 92. Arms 92, 92 are receivable in the receivers 52, 54 of lift frame 22. Each arm 92 includes a latch pin receiving hole 94 therein, the operation of which will be described below.

Figure 3:
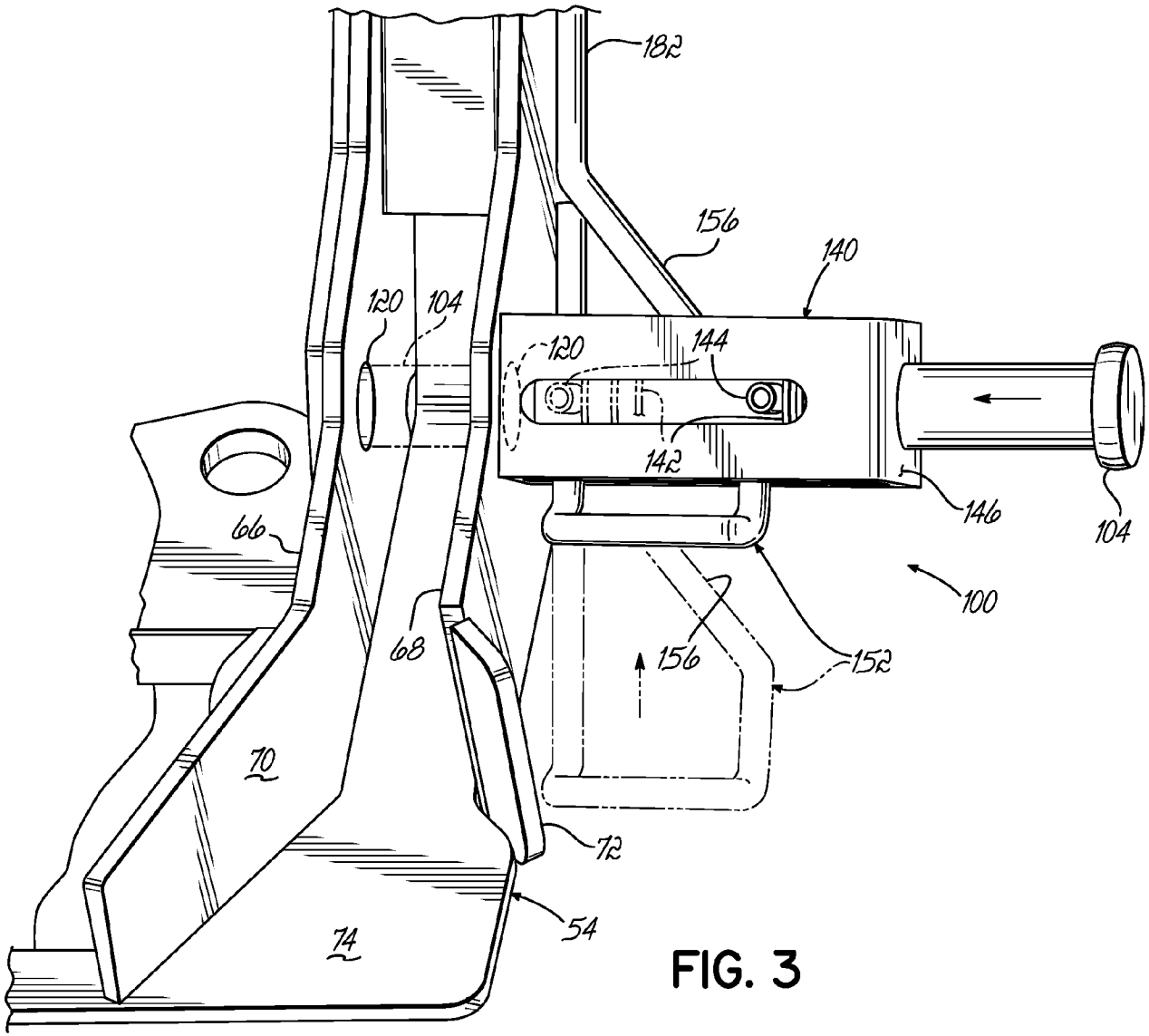
FIG. 3 is an enlarged rear perspective view of the right hand receiver and its respective latch pin.
Figure 4:
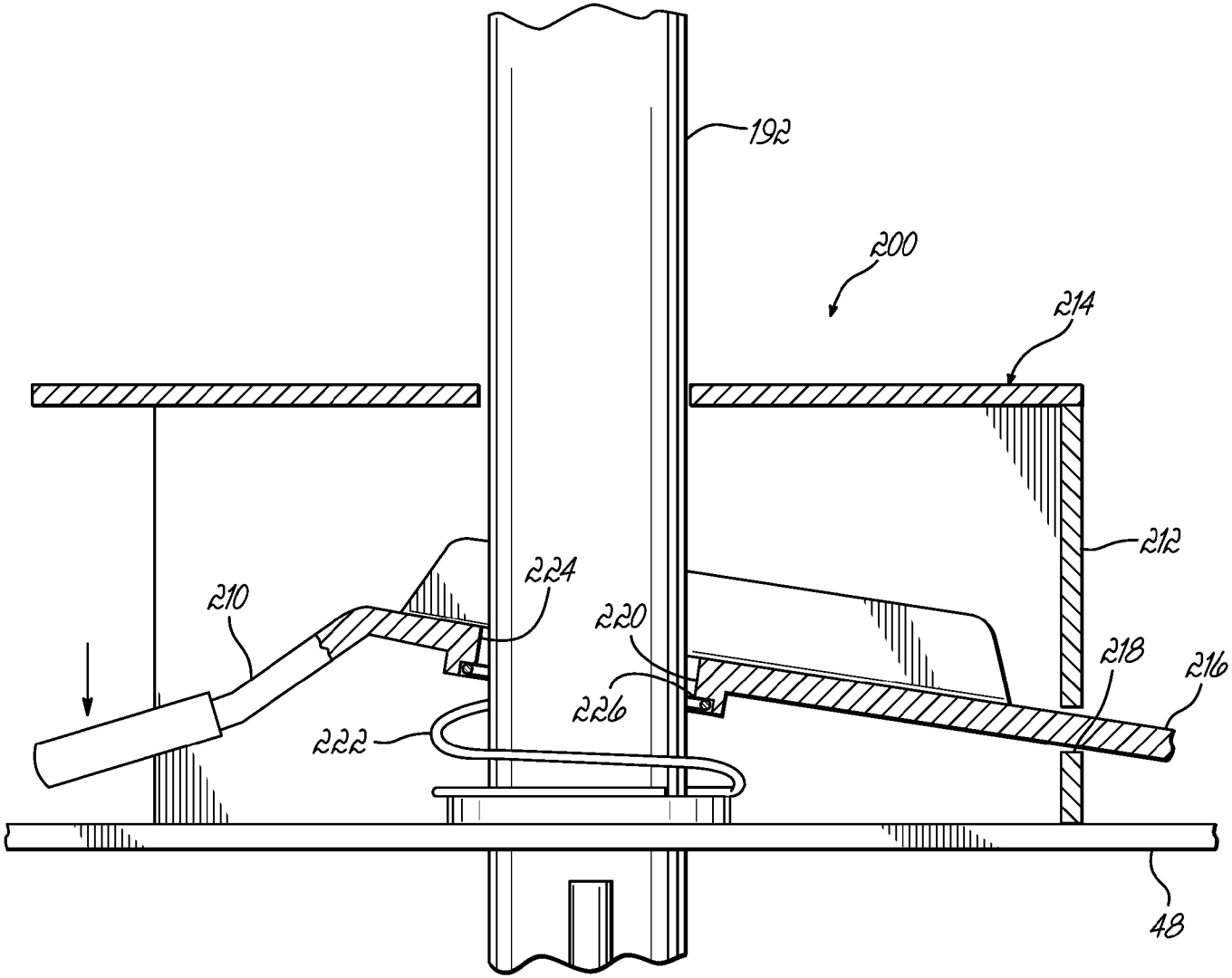
FIG. 4 is an enlarged rear view of the jack stand lock which prevents relative movement of the jack stand relative to the snowplow frame when the jack stand is in the extended position, shown unlocked.
Figure 5:
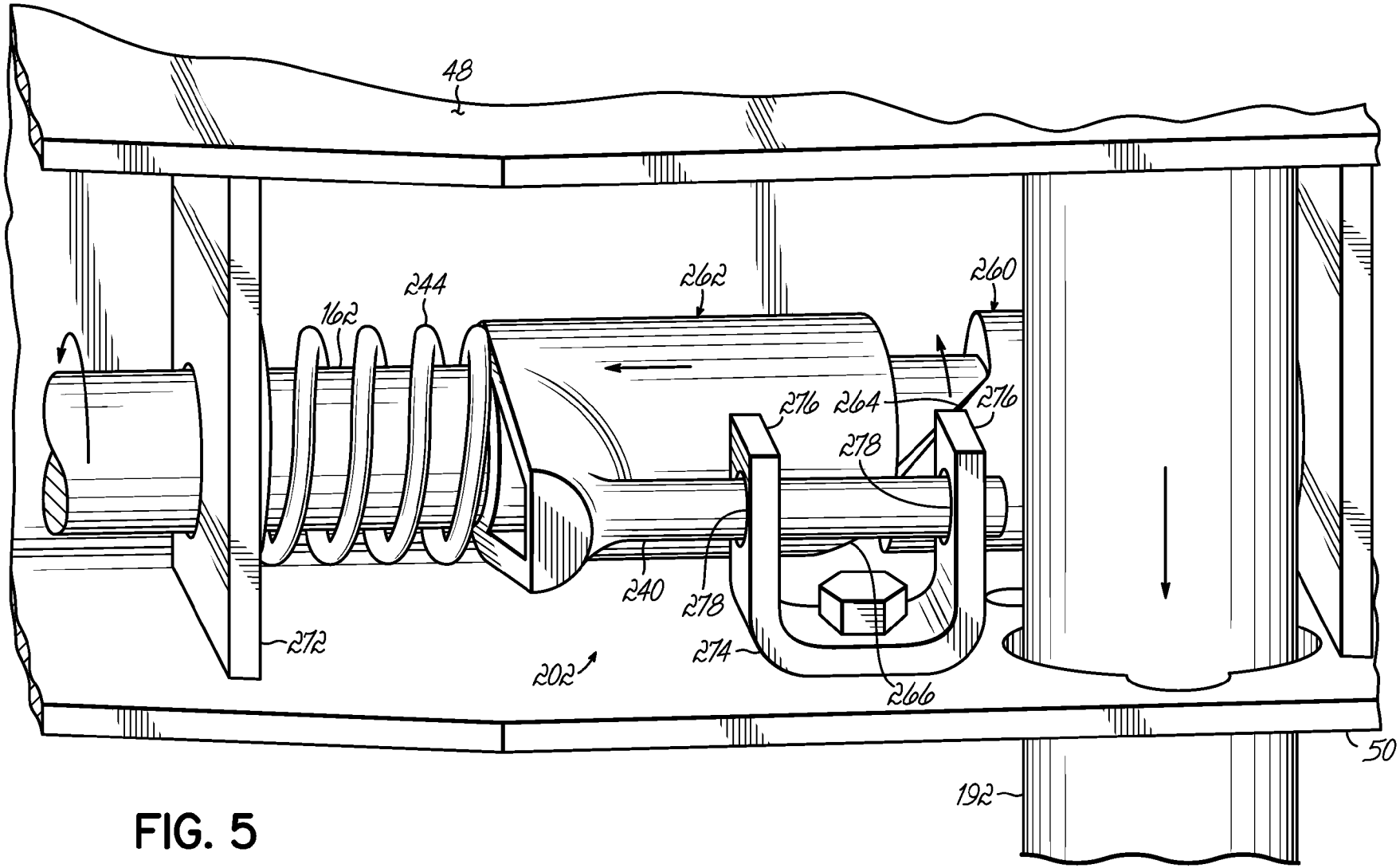
FIG. 5 is an enlarged rear perspective view of the jack stand lock which prevents relative movement of the jack stand relative to the snowplow frame when the jack stand is in the retracted position, shown unlocked.
Figure 6:
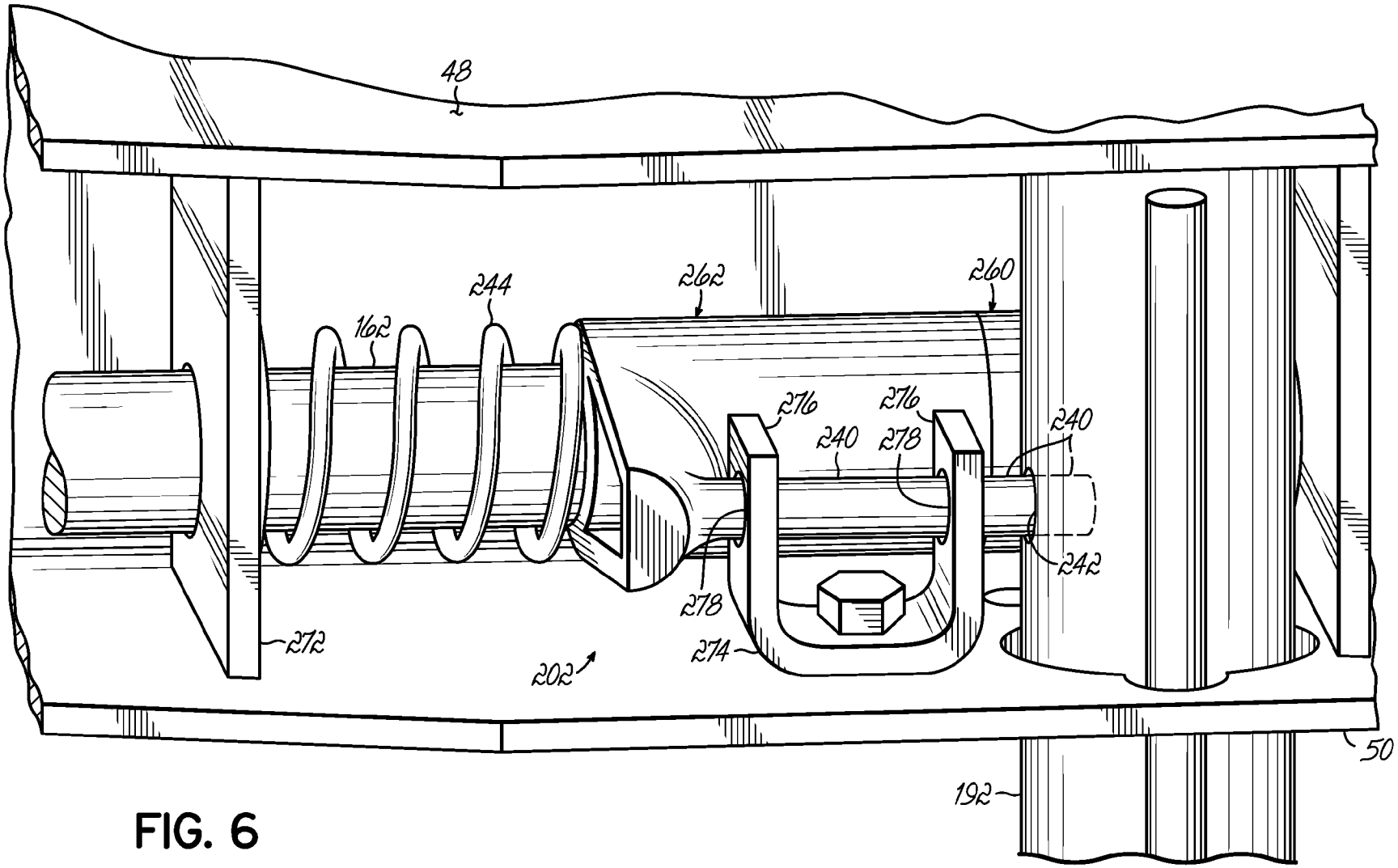
FIG. 6 is the jack stand lock of FIG. 5, shown locked.

Referring now to FIGS. 1 through 3, a latch mechanism 100 can removably secure the snowplow frame 20 to the mount frame 90. Latch mechanism 100 can comprise first and second latch pins 102, 104 associated with receivers 52, 54, respectively. Latch pin 102 is operable to pass through hole 110 in sidewall 56, hole 94 in arm 92 and hole 112 in sidewall 58, when arm 92 is received within receiver 52. Similarly, latch pin 104 is operable to pass through hole 120 in sidewall 68, hole 94 in the other arm 92 and hole 122 in sidewall 66, when the other arm 92 is received within receiver 54. A bracket 130 can be mounted to the outboard side of sidewall 56 of receiver 52 to carry latch pin 102 therein. A spring 132 can bias latch pin 102 into the latched position. More particularly, a cross pin 134, for example roll pin, can be pressed through a hole (not shown) in latch pin 102. Spring 132 can be disposed between cross pin 134 and an inboard surface of end plate 136 of bracket 130. Similarly, a bracket 140 can be mounted to the outboard side of sidewall 68 of receiver 54 to carry latch pin 104 therein. A spring 142 can bias latch pin 104 into the latched position. More particularly, a cross pin 144, for example roll pin, can be pressed through a hole (not shown) in latch pin 104. Spring 142 can be disposed between cross pin 144 and an inboard surface of end plate 146 of bracket 140.

Referring now to FIGS. 2 and 3, receivers 52, 54 can each include a pin extractor 150, 152 associated respectively therewith. Each extractor 150, 152 can include a cam 154, 156, respectively, which can be in the form of a ramp, to cam against cross pins 134, 142, respectively, and hence operably against latch pins 102, 104, respectively, the operation of which will be described below.

A latch lever 160 can be operably associated with the first and second latch pins 102, 104 for simultaneously actuating the latch pins 102, 104 to latched and unlatched positions. Latch lever 160 can include a connecting rod 162 extending transversely of the lift frame 22 and pivotally connected thereto. First and second linkage mechanisms 164, 166 can be connected to latch lever 160 for actuating the extractors 150, 152 associated with latch pins 102, 104, respectively. Linkage 164 can include a linkage arm 170 connected to connecting rod 162 and a linkage rod 172 pivotally connected on a first end to the linkage arm 170 and connected on a second end to the extractor 150. Similarly, linkage 166 can include a linkage arm 180 connected to connecting rod 162 and a linkage rod 182 pivotally connected on a first end to the linkage arm 180 and connected on a second end to extractor 152.

In use, rotation of latch lever 160 counterclockwise (as viewed from the left hand side shown in FIG. 1) from the up position (solid, FIG. 1) to the down position (phantom, FIG. 1), as when detaching the snowplow assembly 12 from the mount assembly 14, actuates linkages 164, 166 to pull extractors 150, 152 upwardly and frontwardly. The ramped cams 154, 156 of the extractors 150, 152 force cross pins 134, 144 laterally outwardly against the bias of springs 132, 142 thus moving latch pins 102, 104 laterally outwardly to their unlatched positions. Rotation of latch lever 160 clockwise from the down position to the up position, as when attaching the snowplow assembly 12 to the mount assembly 14, actuates linkages 164, 166 to push extractors 150, 152 downwardly and rearwardly. The ramped cams 154, 156 of the extractors 150, 152 permit cross pins 134, 144 to move laterally inwardly via the bias of springs 132, 142 thus moving latch pins 102, 104 laterally inwardly to their latched positions.

Referring now to FIGS. 1, 2 and 4-6, a jack stand 190 can be slidably mounted to lift frame 22. Jack stand 190 can include a leg 192 and a foot 194. Jack stand 190 is moveable to and between an extended ground contacting and snowplow frame supporting position (solid, FIG. 1) and a retracted ground noncontacting and snowplow frame nonsupporting position (phantom, FIG. 1; FIG. 2). First 200 and second 202 jack stand locks can be provided to prevent relative movement of the jack stand 190 relative to the lift frame 22 when the jack stand 190 is in the extended position, and to prevent relative movement of the jack stand 190 relative to the lift frame 22 when the jack stand 190 is in the retracted position, respectively.

First jack stand lock 200 can include a lock lever 210 pivoted to a wall 212 of a bracket 214 mounted to top plate 48 of transverse element 46 of lift frame 22. Lock lever 210 can be pivoted to wall 212 as by passing an end 216 of lever 210 through aperture 218 in wall 212. Lock lever 210 can have an aperture 220 therein through which jack stand leg 192 passes, and a spring 222 positioned between lock lever 210 and top plate 48 biasing edges 224, 226 of aperture 220 into contact with jack stand leg 192. Lock lever 210 and bracket 214 are sized and configured so as to prevent inadvertent actuation thereof when snowplow assembly 12 is detached from mount assembly 14.

Spring 222 and lock lever 210 normally prevent upward movement of jack stand leg 192 relative to lift frame 22 while at the same time freely permitting downward movement of jack stand leg 192 relative to the lift frame 22. Pivoting lock lever 210 downwardly (FIG. 4) frees jack stand leg 192 of edges 224, 226 of lock lever aperture 220 thereby permitting upward movement of the jack stand leg 192 relative to the lift frame 22.

Second jack stand lock 202 can include a lock pin 240 moveable into and out of an aperture 242 in jack stand leg 192 and a spring 244 biasing lock pin 240 toward the jack stand leg 192. The spring 244 and lock pin 240 normally prevent downward movement of the jack stand 192 relative to the lift frame 22, whereas urging the lock pin 240 against the bias of the spring 244 frees the jack stand leg 192 from the pin 240 permitting downward movement of the jack stand 190 relative to the lift frame 22. The jack stand 190 can drop by gravity to the extended position when the jack stand leg 192 is freed from pin 240.

The second jack stand lock 202 can further include a cam 260 connected to connecting rod 162 and a cam follower 262 having fixed thereto the lock pin 240. Cam 260 can be in the form of a cylinder encircling connecting rod 162 and fixed thereto and cam follower 262 can be in the form of a cylinder encircling connecting rod 162 and slidable relative thereto. Cam 260 and cam follower 262 can have mating arcuate, for example helix, cam surfaces 264, 266, respectively. Cam follower 262 and hence lock pin 240 can be spring biased toward jack stand leg 192 via spring 244 positioned between cam follower 262 and a plate 272 connected between plates 48 and 50. Cam follower 262 and hence pin 240 can be prevented from rotating via U-bracket 274 fixed to plate 50 and having arms 276, 276 with holes 278, 278 therein through which pin 240 passes.

As illustrated cam 260 is fixedly secured to connecting rod 162 and as such will rotate with connecting rod 162 as latch lever 160 is rotated. Thus, in use, rotation of latch lever 160 counterclockwise (as viewed from the left hand side shown in FIG. 1) from the up position (solid, FIG. 1) to the down position (phantom, FIG. 1), as when detaching the snowplow assembly 12 from the mount assembly 14, not only actuates linkages 164, 166 to unlatch latch pins 102, 104 but also actuates cam 260 to unlock pin 240. The spring rates of springs 132, 142, 222 and 244, and the geometries of their associated mechanisms, can be selected so that jack stand 190 falls by gravity to the ground during the first portion of the arc traversed by lever 160 in moving lever 160 from the up position toward the down position, while latch pins 102, 104 remain latched. Then, as lever 160 is moved the remaining portion of the arc to the down position, latch pins 102, 104 are moved to their unlatched positions.

As described above rotation of latch lever 160 clockwise from the down position to the up position, as when attaching snowplow assembly 12 to mount assembly 14, actuates linkages 164, 166 to move latch pins 102, 104 to their latched positions. Once so latched, jack stand lock lever 210 can be pressed downwardly freeing jack stand leg 192. Jack stand leg 192 is then manually pulled upwardly until jack stand lock pin 240 is seated in aperture 242 in jack stand leg 192.

For both attaching the snowplow assembly 12 to and detaching the snowplow assembly 12 from the mount assembly 14 a force should be applied to the lift frame 22, such as on transverse element 44, in the direction of the mount assembly 14 as latch lever 160 is rotated. Such movement facilitates alignment of the latch pins 102, 104 with the holes 94 in the arms 92. This movement is possible because tension spring 84, extended during normal operation of snowplow assembly 12, retracts when snowplow assembly 12 is parked, blade 32 is dropped to the ground and the hydraulic control is placed in the "float" condition releasing the pressure in the lift cylinder 86, pulling lift arm 80 downwardly to its fully collapsed positioned and creating slack in the lift chain 82.

Latch lever 160 and linkage mechanisms 164, 166 are designed so that the mechanical advantage produced thereby is insufficient to unlatch "loaded" latch pins 102, 104, thus preventing the snowplow assembly 12 from "collapsing in a heap." In other words, and as discussed above, initial rotation of latch lever 160 permits jack stand 190 to fall by gravity and support the snowplow assembly 12. Further rotation of latch lever 160 to retract latch pins 102, 104 is not possible until lift frame 22 is pivoted relative to A-frame 24 and toward mount frame 90 to unload latch pins 102, 104. Jack stand 190 and jack stand foot 194 are sized, configured and located to permit such pivoting of lift frame 22 relative to A-frame 24 without causing instability of the snowplow assembly 12 during such pivoting.

Those skilled in the art will readily recognize numerous adaptations and modifications which can be made to the present invention which will result in an improved snowplow and mount assembly, yet all of which will fall within the spirit and scope of the present invention as defined in the following claims. Accordingly, the invention is to be limited only by the scope of the following claims and their equivalents.

We claim:

1. A snowplow and mount assembly comprising:

a mount frame adapted to be secured to a vehicle having a longitudinal axis;

a snowplow frame including a lift frame and an A-frame pivotally connected to said lift frame on a rearward end of said A-frame;

a plow blade mounted on a forward end of said A-frame;

one of said mount frame and said lift frame having first and second arms and the other of said mount frame and said lift frame having first and second receivers, said first and second receivers receiving said first and second arms, respectively upon relative movement therebetween in a direction generally parallel to the longitudinal axis of the vehicle;

first and second moveable latch pins, respective ones of which removably secure said first and second arms in said first and second receivers; and a latch lever operably associated with said first and second latch pins for moving said latch pins to a latched position to secure said first and second arms in said first and second receivers and for moving said latch pins to an unlatched position to permit said first and second arms to move out of said first and second receivers;

a lift cylinder connected between said lift frame and said A-frame; and structure connecting said lift frame and said plow blade, said connecting structure including resilient and non-resilient portions;

said resilient portion creating slack in said non-resilient portion when said plow blade is dropped to the ground and pressure is released from said lift cylinder thereby permitting said lift frame to be rotated relative to said A-frame toward said mount frame.

2. The assembly of claim 1 wherein said connecting structure resilient and non-resilient portions comprise a tension spring and a chain respectively.

3. The assembly of claim 1 wherein said connecting structure resilient and non-resilient portions comprise a tension spring and a cable respectively.

4. The assembly of claim 1 further including a jack and wherein said jack drops by gravity before said latch pins unlatch.

* * * * *